US007471802B2

(12) United States Patent
Akino et al.

(10) Patent No.: US 7,471,802 B2
(45) Date of Patent: Dec. 30, 2008

(54) BOUNDARY MICROPHONE

(75) Inventors: Hiroshi Akino, Machida (JP); Satoshi Uchimura, Machida (JP)

(73) Assignee: Kabushiki Kaisha Audio-Technica, Machida-Shi, Tokyo (JP)

( * ) Notice: Subject to any disclaimer, the term of this patent is extended or adjusted under 35 U.S.C. 154(b) by 459 days.

(21) Appl. No.: 11/221,876

(22) Filed: Sep. 9, 2005

(65) Prior Publication Data

US 2006/0078149 A1 Apr. 13, 2006

(30) Foreign Application Priority Data

Sep. 30, 2004 (JP) ..... 2004-286393

(51) Int. Cl.
*H04R 9/08* (2006.01)
*H04R 1/02* (2006.01)

(52) U.S. Cl. ..... 381/355; 381/359; 381/334; 381/361

(58) Field of Classification Search ..... 381/355, 381/189, 334
See application file for complete search history.

(56) References Cited

U.S. PATENT DOCUMENTS

| | | | | |
|---|---|---|---|---|
| 3,909,529 | A * | 9/1975 | Morrow et al. | 381/355 |
| 4,908,737 | A * | 3/1990 | Murakami et al. | 361/809 |
| 5,204,907 | A * | 4/1993 | Staple et al. | 381/91 |
| 5,365,595 | A * | 11/1994 | Li | 381/360 |
| 5,863,633 | A * | 1/1999 | Squires et al. | 428/90 |
| 6,148,089 | A * | 11/2000 | Akino | 381/356 |
| 6,188,773 | B1 * | 2/2001 | Murata et al. | 381/361 |
| 6,932,187 | B2 * | 8/2005 | Banter et al. | 181/149 |
| 2001/0008672 | A1 * | 7/2001 | Norvell et al. | 428/90 |
| 2004/0033334 | A1 * | 2/2004 | Merovitz | 428/90 |
| 2004/0213426 | A1 * | 10/2004 | MacRae | 381/355 |
| 2005/0077102 | A1 * | 4/2005 | Banter et al. | 181/149 |

FOREIGN PATENT DOCUMENTS

| | | | |
|---|---|---|---|
| GB | 2321819 A | * | 8/1998 |
| GB | 2369522 A | * | 5/2002 |
| JP | H07-43015 U | | 8/1995 |
| JP | 2001-148897 | * | 5/2001 |

OTHER PUBLICATIONS

Brouns, A.; "Microphone design and selection for deep-submergence environments", Jan. 29, 2003, Engineering in the Ocean Environment Conf., pp. 260-263.*

Riko, Y.; "Environmentally robust electret condenser microphone", Sep. 11, 2005, Electrets, 2005. ISE-12. 2005 12th International Symposium on; pp. 382-385.*

* cited by examiner

*Primary Examiner*—Suhan Ni
*Assistant Examiner*—Ryan C Robinson
(74) *Attorney, Agent, or Firm*—Manabu Kanesaka

(57) ABSTRACT

There is provided a boundary microphone especially suitable for outdoor applications, which has strong waterproof and high wind noise resistance. In a boundary microphone in which a microphone case 1 includes a flat base portion 10 the upper surface side of which is open, and a microphone cover 20 having a large number of openings, which is attached to the base portion 10 so as to cover the upper surface of the base portion 10, and a microphone unit 31 is housed in the microphone case 1, a pile 23 is flocked by electrostatic flocking over the whole surface of at least the outer surface of the microphone cover 20 including a connecting portion 20*a* between the microphone cover 20 and the base portion 10, and the pile 23 is subjected to water repellent processing.

5 Claims, 2 Drawing Sheets

BOUNDARY MICROPHONE

TECHNICAL FIELD

The present invention relates to a boundary microphone and, more particularly, to a water proofing technique for a boundary microphone.

BACKGROUND ART

A boundary microphone is used by being placed on a table or a floor, for example, at a TV studio or a conference hall, and therefore it is called a surface mount microphone. In order to make the presence of boundary microphone inconspicuous, the boundary microphone uses a flat microphone case having a thin appearance of restrained height (for example, refer to Japanese Utility Model Application Publication No. H07-43015).

Specifically, the microphone case of boundary microphone has a flat base portion whose upper surface side is open, the base portion being mounted with a microphone unit and a circuit board, and a microphone cover having a large number of openings (acoustic wave introduction holes) is put from the upside of the base portion. Usually, the base portion is formed by casting such as zinc die casting, and as the microphone cover, a punching plate or a wire netting body of hard metal wire is used.

Since the boundary microphone is used by being placed on a table or a floor, water (for example, drinking water spilled by a toppled cup) is often poured on the boundary microphone or the boundary microphone is often dipped in water, as compared with a stand microphone and a hand-held microphone.

Since water causes malfunction of microphone, for the boundary microphone, the microphone cover is subjected to water repellent processing, or a gasket such as sponge having water repellency is inserted in a connecting portion between the microphone cover and the base portion. However, since the microphone cover is flat and wide in area, and moreover is formed with a large number of openings, it cannot be said that only the water repellent processing provides a sufficient water proofing effect.

The boundary microphone has been used indoors exclusively. Recently, however, the inconspicuous presence of boundary microphone has been appreciated, and the use thereof in the field of security has been studied. As one example thereof, the boundary microphone is used jointly with a security video camera installed out of doors. This joint use intends to further enhance the reliability of security by picking up not only image but also sound out of doors. In the case where the boundary microphone is installed out of doors, stronger waterproof is required than in the case where the boundary microphone is used indoors. In addition, countermeasures against wind noise must be taken.

SUMMARY OF THE INVENTION

Accordingly, an object of the present invention is to provide a boundary microphone especially suitable for outdoor applications, which has strong waterproof and high wind noise resistance.

To achieve the above object, the present invention provides a boundary microphone in which a microphone case includes a flat base portion the upper surface side of which is open, and a microphone cover having a large number of openings (acoustic wave introduction holes), which is attached to the base portion so as to cover the upper surface of the base portion, and a microphone unit is housed in the microphone case, wherein a pile flocked by electrostatic flocking is provided over the whole surface of at least the outer surface of the microphone cover including a connecting portion between the microphone cover and the base portion, and the pile is subjected to water repellent processing.

In the present invention, from the viewpoint of appearance (texture), the pile is preferably a nylon pile having a thickness of 1 to 3 denier and a length of 0.5 to 1.0 mm. If the pile length exceeds 1.0 mm, the pile unfavorably gets tangled together.

According to this configuration, the pile flocked by electrostatic flocking is substantially perpendicular to the surface of each part of the microphone cover, and is subjected to water repellent processing. Therefore, a portion that a liquid drop touches is limited to a very small area at the tip end of the pile, so that a great water proofing effect can be achieved. Also, since the pile is flocked even in the connecting portion between the microphone cover and the base portion, the connecting portion is sealed by the pile. Further, since the pile is present even in the openings of the microphone cover, wind noise can be reduced.

DETAILED DESCRIPTION

Figure 1:
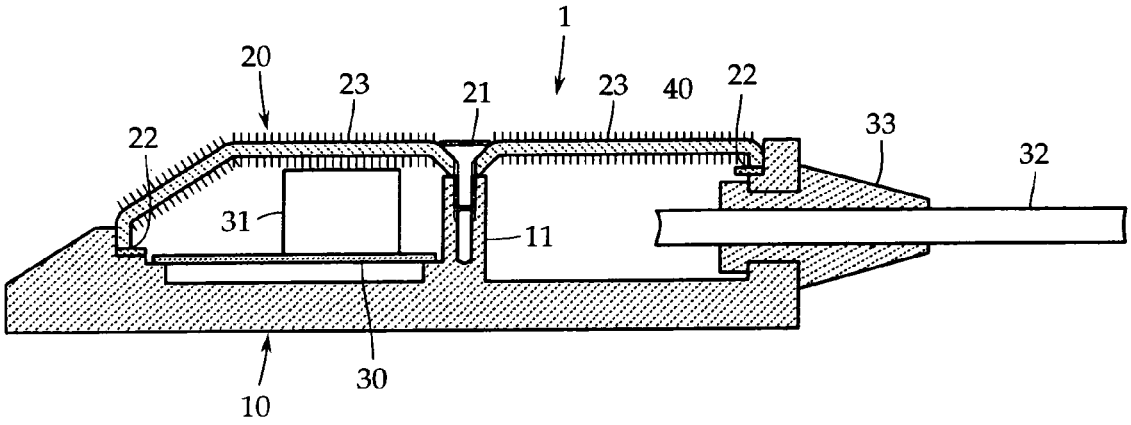
FIG. 1 is a sectional view of a boundary microphone in accordance with the present invention.
Figure 2:
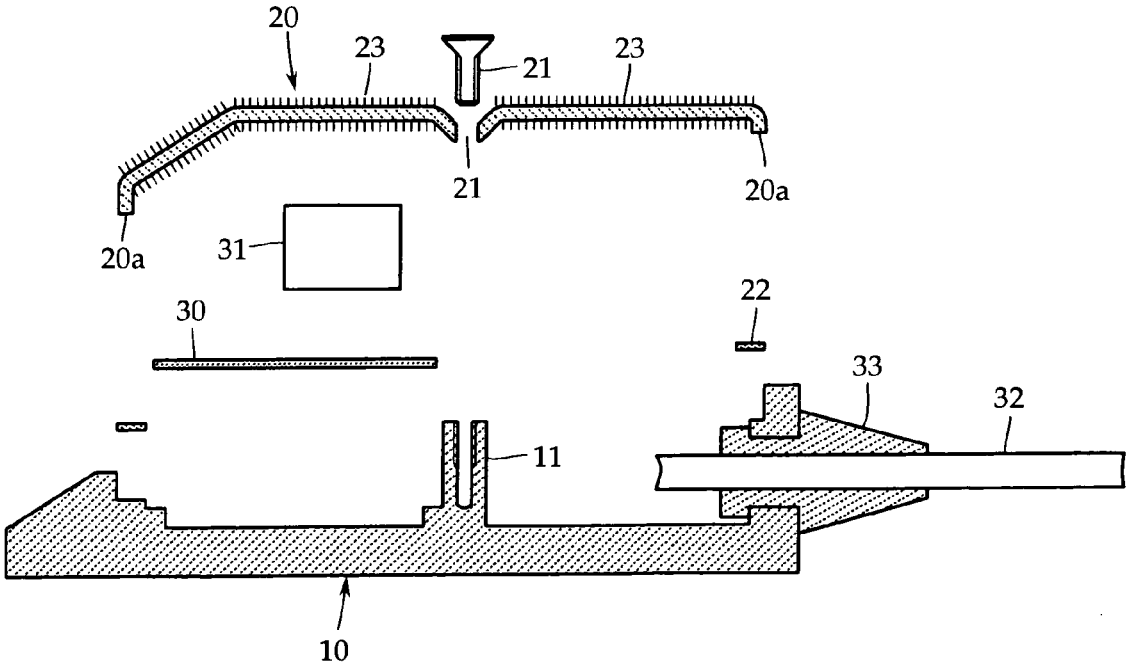
FIG. 2 is an exploded sectional view of FIG. 1.

An embodiment of the present invention will now be described with reference to FIGS. 1 and 2. The present invention is not limited to this embodiment. FIG. 1 is a sectional view of a boundary microphone in accordance with the present invention, and FIG. 2 is an exploded sectional view of FIG. 1.

In a boundary microphone in accordance with the present invention, a microphone case 1 includes a flat base portion 10 the upper surface side of which is open, and a microphone cover 20 having a large number of openings (acoustic wave introduction holes), which is attached to the base portion 10 so as to cover the upper surface of the base portion 10.

Usually, the base portion 10 is formed by casting such as zinc die casting. Besides, a press molded product of a metal or sometimes a molded product of a synthetic resin may be used as the base portion 10. Also, as the microphone cover 20, a punching plate (perforated plate) formed of iron etc. is used. In place of the punching plate, a wire netting body may be used, or painting may be performed. Depending on a microphone type, a molded product of a synthetic resin is sometimes used as the microphone cover 20.

In this example, the microphone cover 20 is attached to the base portion 10 with a screw. From the viewpoint of appearance (design), it is preferable that the microphone cover 20 be attached to the base portion 10 at one point using a fixing screw 21 and a boss 11 erected on the base portion 10. However, the microphone cover 20 may be attached to the base portion 10 at a plurality of points with screws. In some cases, the microphone cover 20 may be fixed to the base portion 10 by a method without the use of screw.

In the case where the base portion 10 and the microphone cover 20 are made of a metal, a conductive gasket 22 is preferably interposed between the base portion 10 and the microphone cover 20 to enhance the electromagnetic shielding property of the microphone case 1.

In a space of the microphone case 1, which is formed by the base portion 10 and the microphone cover 20, a circuit board 30 and a microphone unit 31 are housed. The microphone unit 31 may be housed in the microphone case 1 in a state of being mounted on the circuit board 30, or may be housed separately from the circuit board 30. In the boundary microphone, usually, a condenser microphone unit is used as the microphone unit 31.

Although not shown in the figures, the circuit board 30 may be mounted with an impedance converter, a tone adjustment circuit, an output circuit, and the like. Also, a microphone cord 32 is connected to the circuit board 30, and is pulled out of the base portion 10 via a cord bush 33.

Figure 3:
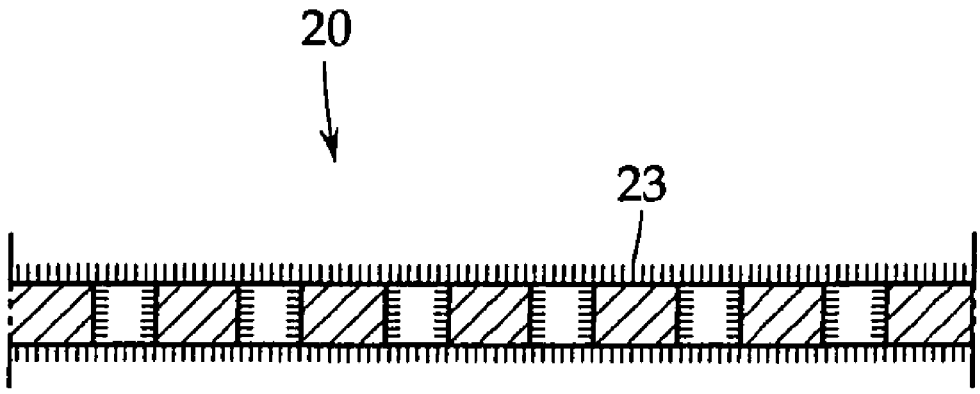
FIG. 3 is a partial sectional view of the microphone cover.

As shown in FIG. 3, the microphone cover 20 is formed with a large number of openings servings as acoustic wave introduction holes. Usually, each of the openings is a round hole, and has a diameter of about 1.0 to 1.5 mm. In the present invention, apile 23 is flocked on the microphone cover 20 in a fluff form by electrostatic flocking. It is to be noted that electrostatic flocking can be performed even if the microphone cover 20 is made of a synthetic resin.

In this example, the pile 23 is flocked over the whole surfaces of top and back surfaces of the microphone cover 20. However, the pile 23 may be provided at least only on the outer surface side of the microphone cover 20. In both of the cases, the pile 23 is also provided in a connecting portion 20*a* between the microphone cover 20 and the base portion 10 and an opening portion.

In the case of electrostatic flocking, the pile 23 is flocked so as to be substantially perpendicular to the surface of each part of the microphone cover 20. In the present invention, the flocked pile 23 is subjected to water repellent processing. As a water repellent processing agent, a PTFE (polytetrafluoroethylene) based or silicone based water repellent processing agent is preferably used.

According to this configuration, a liquid drop falling on the microphone cover 20 touches the tip end of the pile 23 as a particulate, and a large drop rolls down from the pile surface. Also, a small drop stays at the tip end of the pile 23, and does not intrude into the microphone case 1 through the opening.

Also, a gap in the connecting portion 20*a* between the microphone cover 20 and the base portion 10 is also sealed by the pile 23 subjected to water repellent processing, so that a liquid drop does not intrude through this gap. Further, since the pile 23 is present in the openings in the microphone cover 20, wind noise can be reduced.

Solely from the viewpoint of appearance (texture), the pile 23 preferably has a thickness of 1 to 3 denier and a length of 0.5 to 1.0 mm. In particular, a nylon pile having a thickness of 2 denier is preferable.

The present application is based on, and claims priority from, Japanese Application Serial Number JP2004-286393, filed Sep. 30, 2004, the disclosure of which is hereby incorporated by reference herein in its entirety.

The invention claimed is:

1. A boundary microphone in which a microphone case includes a flat base portion, an upper surface side of which is open, and a microphone cover having a large number of acoustic wave introduction holes, which is attached to the base portion so as to cover the upper surface of the base portion, and a microphone unit is housed in the microphone case, wherein a pile flocked by electrostatic flocking is directly provided over a whole surface of an outer surface of the microphone cover, and inside of the holes so that the pile has a wind noise resistance, and a connecting portion between the microphone cover and the base portion, and the pile has a water repellent property.

2. The boundary microphone according to claim 1, wherein the pile is a nylon pile having a thickness of 1 to 3 denier and a length of 0.5 to 1.0 mm.

3. A boundary microphone, comprising:

a microphone case having a flat base portion and an opening provided at an upper surface side of the microphone case, a microphone cover mounted on the microphone case so as to cover the opening and having a plurality of acoustic wave introduction holes, a connecting portion for connecting the microphone case and the microphone cover, a microphone unit housed in the microphone case, and a pile substantially entirely and directly provided on an outer surface of the microphone cover and flocked by electrostatic flocking, the pile having a water repellent property, wherein the pile further covers the connecting portion and inside the holes so that the pile has a wind noise resistance.

4. The boundary microphone according to claim 3, wherein the pile is a nylon pile having a thickness of 1 to 3 denier and a length of 0.5 to 1.0 mm.

5. The boundary microphone according to claim 4, wherein the hole has a diameter of 1.0 to 1.5 mm so that the pile enters the hole and is flocked by electrostatic flocking.

* * * * *